US005340673A

United States Patent [19]

Tateyama et al.

[11] Patent Number: 5,340,673

[45] Date of Patent: Aug. 23, 1994

[54] METHOD OF MANUFACTURING A PHOSPHOR SCREEN OF A CATHODE RAY TUBE

[75] Inventors: Norihiro Tateyama, Saitama; Katsutoshi Ohno, Tokyo; Tsuneo Kusunoki, Kanagawa, all of Japan

[73] Assignee: Sony Corporation, Tokyo, Japan

[21] Appl. No.: 35,242

[22] Filed: Mar. 22, 1993

[30] Foreign Application Priority Data

Mar. 25, 1992 [JP] Japan ..... 4-067569

[51] Int. Cl.[5] ..... G03C 5/00

[52] U.S. Cl. ..... 430/23; 430/28; 427/64; 427/68

[58] Field of Search ..... 430/23, 28; 427/64, 427/68

[56] References Cited

U.S. PATENT DOCUMENTS 5,073,463 12/1991 Fujita ..... 430/28

*Primary Examiner*—Steve Rosasco

*Attorney, Agent, or Firm*—Lewis H. Eslinger; Jay H. Maioli

[57] ABSTRACT

A method of forming a phosphor screen in which a color filter layer is formed between a phosphor layer and an inner surface of a panel having a slurry in which a fine particle pigment and transparent particles are dispersed into a photosensitive liquid coated on the inner surface of the panel. Then, the color filter layer is formed by exposure and development. When the color filter layer that constitutes one portion of a phosphor screen of a color cathode ray tube is formed in this manner, an adhesive force with which the color filter layer is bonded onto the panel can be increased and a transmittance of the color filter layer can be improved.

3 Claims, 3 Drawing Sheets

METHOD OF MANUFACTURING A PHOSPHOR SCREEN OF A CATHODE RAY TUBE

BACKGROUND OF THE INVENTION

1. Field of the Invention

The present invention relates to a method of manufacturing a phosphor screen of a cathode ray tube.

2. Description of the Related Art

As a color cathode ray tube of high contrast, there is known a color cathode ray tube in which a panel having a phosphor screen formed on its inner surface is made of a dark glass having a transmittance of about 40% to 45% or a color cathode ray tube in which a phosphor screen is formed of a so-called pigment phosphor in which a pigment of the same color is deposited on a phosphor particle.

In the former color cathode ray tube in which the panel is formed of the dark glass, an external light is absorbed by the dark glass so that a contrast thereof can be increased. At the same time, however, a light emitted from the phosphor screen also is absorbed by the dark glass so that a brightness thereof is lowered.

In the latter cathode ray tube in which the phosphor screen is formed by using the pigment phosphor, an external light is absorbed by the pigment so that a contrast thereof can be increased. In this case, however, phosphor particles of several layers (e.g., three to four layers) are laminated to form the phosphor screen. As a result, a light from the phosphor particle is partly absorbed by the pigment with the result that a brightness thereof is lowered about 10 to 15%.

In order to improve the aforesaid defects, there has been developed a color cathode ray tube in which a color filter layer is formed on the inner surface of the panel and a phosphor layer is formed on the color filter layer to form a phosphor screen.

In this color cathode ray tube, a glass having a high transmittance can be utilized as a panel glass and an amount of phosphor can be increased as compared with the pigment phosphor. Also, external light is absorbed by the color filter layer so that a high contrast and a high brightness can be obtained.

The color filter layer for the phosphor screen is formed as follows:

A photosensitive liquid made of polyvinyl alcohol (PVA) and ammonium dichromate (ADC) is coated with a slurry in which a fine particle inorganic pigment is dispersed, dried, exposed with ultraviolet rays by using a color selecting electrode as a photo mask and then developed to thereby form the color filter layer.

In the above method of forming the color filter layer, upon exposure, ultraviolet rays are absorbed by the pigment and the transmittance of ultraviolet rays is decreased. As a result, a boundary that is in contact with the glass panel is not exposed sufficiently so that a loose failure of the color filter layer occurs. If an exposure amount is increased, then a width of color filter layer is increased and a predetermined width cannot be obtained.

OBJECTS AND SUMMARY OF THE INVENTION

Therefore, it is an object of the present invention to provide an improved method of forming a phosphor screen of a cathode ray tube in which the aforesaid shortcomings and disadvantages of the prior art can be eliminated.

More specifically, it is an object of the present invention to provide a method of forming a phosphor screen of a cathode ray tube in which a loose failure can be prevented.

It is another object of the present invention to provide a method of forming a phosphor screen of a cathode ray tube in which a color filter layer of a predetermined width can be obtained.

It is still another object of the present invention to provide a method of forming a phosphor screen of a cathode ray tube for use in a color cathode ray tube.

It is a further object of the present invention to provide a method of forming a phosphor screen of a cathode ray tube for use in a video projector.

According to an aspect of the present invention, there is provided a method of manufacturing a phosphor screen of a cathode ray tube which comprises the steps of forming a coating layer of a slurry comprising pigment particles, a photo resist, transparent particles and a dispersant on an inner surface of a panel of the cathode ray tube, exposing the coating layer by a predetermined photo mask having a predetermined pattern, developing said exposed coating layer and forming a color filter layer, and forming a phosphor layer on the color filter layer.

According to the present invention, there is provided a method of forming a phosphor screen of a cathode ray tube in which a color filter layer is formed between a phosphor layer and the inner surface of a panel. A composition mainly composed of a fine particle pigment, a photosensitive material, a transparent particle and a dispersant is coated on the inner surface of the panel, which is exposed and developed through a predetermined photo mask to thereby form the color filter layer.

As the transparent particle, there can be used a particle which is selected from inorganic material particles having high transmittance such as silica micro-bead, baked alumina, quartz bead or the like and a resin-based particle having high transmittance which can be decomposed by heat of less than 450°, such as acryl-based resin particles, polyethylene-based resin particle or the like.

A particle diameter of the transparent particle is 0.1 μm to 15 μm, preferably 2 μm to 10 μm and more preferably 3.0 μm to 5.0 μm. If the particle diameter of the transparent particle is smaller than 0.1 μm, then the transparent particle is not effective. If it is larger than 15 μm, then a contrast is lowered.

As to the amount of the transparent particle to be added, if the transparent particle is the resin-based particle, the resin-based particle of 10 weight % to 100 weight % may be added. If the amount added is smaller than 10 weight %, there can be no advantages achieved. If it is larger than 100 weight %, then a contrast is lowered. If the transparent particle is the inorganic material particle, the inorganic material particle of 20 weight % to 200 weight % may be added to the pigment. If the amount added of the inorganic material particle is smaller than 20 weight %, then there can be no advantages achieved. If on the other hand it is larger than 200 weight %, then a contrast is lowered.

Further, according to the present invention, as the transparent particle, there can be utilized the transparent particle that can be decomposed at temperatures higher than a predetermined temperature, such as the resin-based particle that can be decomposed at temperatures less than 450° C. such as polyethylene-based particles, acryl-based particles or the like. The transparent particle of 0.1 weight % to 70 weight % is contained in the total amount of the composition and the transparent particle of 10 weight % to 100 weight % is contained in the fine particle pigment.

According to the present invention, there is utilized the composition in which the fine particle pigment and the transparent particle are dispersed into the photosensitive material. When this composition is coated on the inner surface of the panel and then exposed, a light is passed through the transparent particle and introduced into a boundary with the panel and a sufficient exposure can be carried out. Therefore, without increasing the exposure amount, a bonding force with the inner surface of the panel can be increased and the occurrence of a so-called loose failure can be avoided. At the same time, the color filter layer of a predetermined width can be obtained.

Further, the transparent particle acts as a bridge for the fine particle pigment and a transmittance of the color filter after the baking process can be increased.

Furthermore, when the transparent particle that can be decomposed at temperature higher than a predetermined temperature is used as the transparent particle, the transparent particle is lost from the color filter layer in the baking process. Therefore, unlike the case that the inorganic material particle is used as the transparent particle, the phosphor screen can be prevented from being seen whitish, thereby increasing the contrast much more.

The above and other objects, features, and advantages of the present invention will become apparent from the following detailed description of illustrative embodiments thereof to be read in conjunction with the accompanying drawings, in which like reference numerals are used to identify the same or similar parts in the several views.

DETAILED DESCRIPTION OF THE PREFERRED EMBODIMENTS

The present invention will now be described with reference to the drawings.

EMBODIMENT 1

Figure 1A:
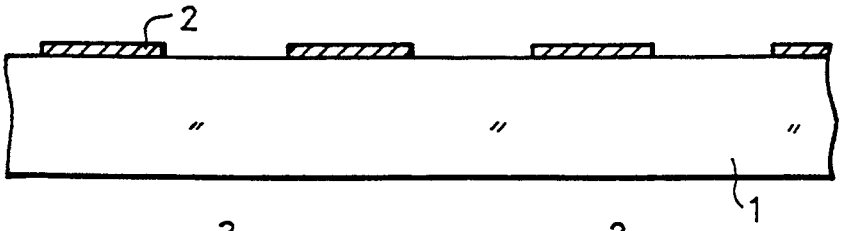
FIGS. 1A through 1F are process diagrams showing an embodiment of a method of manufacturing a phosphor screen of a cathode ray tube according to the present invention, respectively.

As shown in FIG. 1A, black stripe layers (light absorption layers) 2 of predetermined pattern are formed on an inner surface of a panel 1. The black stripe layers 2 are formed as follows:

A photosensitive film made of polyvinyl alcohol (PVA) and ammonium dichromate (ADC), for example, is coated on the inner surface of the panel 1, dried, exposed with ultraviolet rays by using a color selecting electrode as a photo mask (photosensitive film is exposed three times in response to red, green and blue while the position of a light source is relatively changed), and then developed by a rinsing process using water to thereby form stripe-shaped resist layers at positions corresponding to the respective colors. Then, a carbon slurry is coated on the whole surface including the resist layers, dried and then developed in inversion (i.e., by removing the carbon layers formed on the resist layers together with the resist layers), thereby forming carbon stripes of predetermined pattern, i.e., black stripes 2.

Figure 1B:
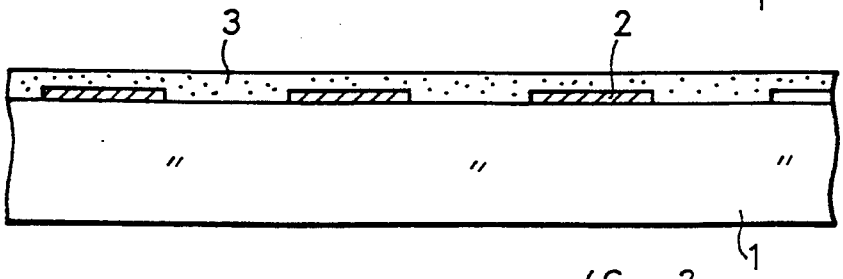

As shown in FIG. 1B, a suspension (slurry) having the following composition in which a green pigment and silica micro-beads that are transparent particles are dispersed into a photosensitive liquid, in this embodiment, a PVA-ADC-system photosensitive liquid is uniformly coated on the inner surface of the panel 1 with a thin film thickness by a rotary coating method, and then dried to thereby form a green filter coating film 3.

| COMPOSITION | |
|---|---|
| green pigment ($TiO_2ZnO.CoO.NiO$) (manufactured by DAINICHISEIKA COLOR AND CHEMICALS CORP. under the trade name of DAIPYROXIDE COLOR GREEN) | 5.0 weight % |
| silica micro-beads (particle diameter is 3.0 μm to 5.0 μm) | 5.0 weight % |
| polyvinyl alcohol | 3.0 weight % |
| ammonium dichromate | 0.2 weight % |
| surface-active agent | 0.1 weight % |
| water | 81.7 weight % |

Figure 1C:
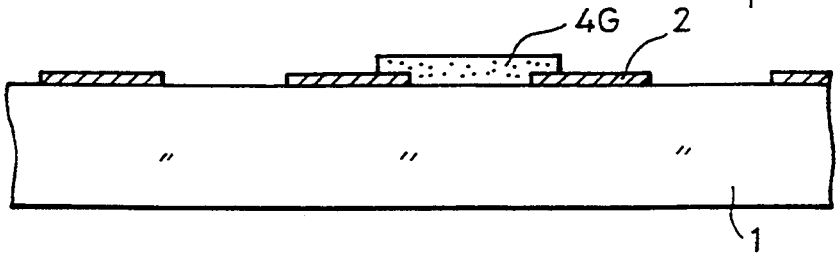

Then, the coating film 3 is exposed with ultraviolet rays at its position corresponding to the green from the inner surface of the panel 1 by using the color selecting electrode as the photo mask. Thereafter, the coating film 3 may be selectively exposed in an auxiliary exposure fashion with ultraviolet rays at the same position from the outer surface of the panel 1 through the photo mask or the like. Then, the product is developed with a hot water to thereby form a green filter layer, i.e., green filter stripe 4G on the position of green as shown in FIG. 1C.

A blue pigment (e.g., cobalt aluminate) is utilized and a suspension (slurry) having the same composition is made. Then, processes similar to those of FIGS. 1B and 1C are repeated to form a blue filter stripe 4B on the inner surface of the panel 1 at its position of blue.

Subsequently, a red pigment (e.g., sulfoselenide cadmium or ferric oxide) is utilized and a suspension (slurry) having the same composition is made. Then, processes similar to those of FIGS. 1B and 1C are repeated to form a red filter stripe 4R on the inner surface of the panel 1 at its position of red.

Figure 1D:
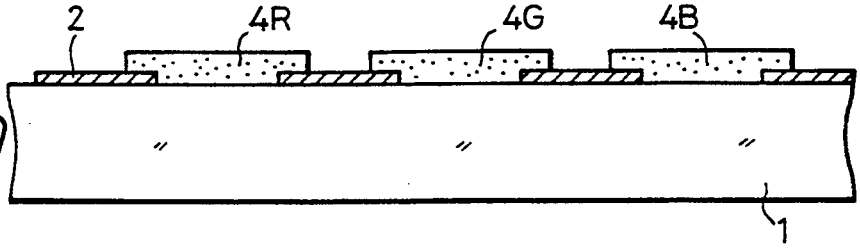
Figure 1E:
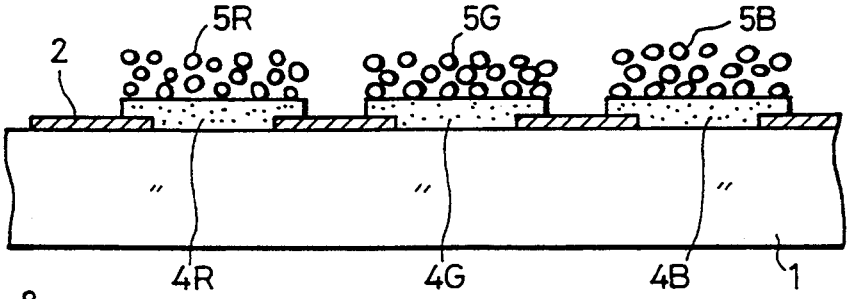

In this way, there are formed green, blue and red, three-color filter stripes 4G, 4B and 4R as shown in FIG. 1D.

As shown in FIG, 1E, a green phosphor stripe 5G, a blue phosphor stripe 5B and a red phosphor stripe 5R are respectively formed on the green filter stripe 4G, the blue filter stripe 4B and the red filter stripe 4R respectively by the ordinary slurry method.

Figure 1F:
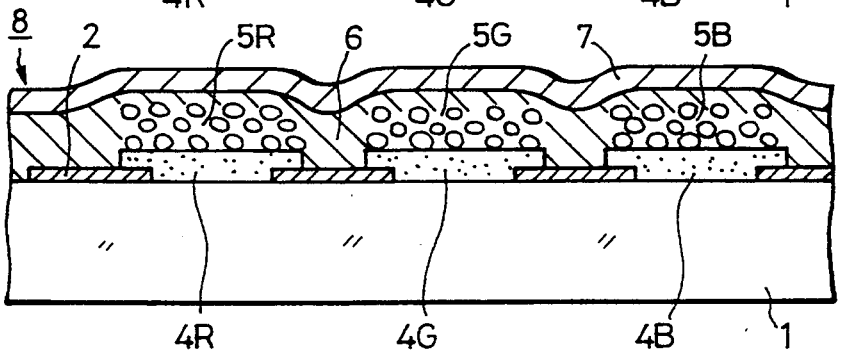

Thereafter, as shown in FIG. 1F, an intermediate film 6 formed of an acrylic layer, for example, is deposited and a metal-backing layer 7 is formed by a vacuum deposition method, thereby a target color phosphor screen 8 being formed.

According to the above-mentioned example 1, when the color filter stripes 4G, 4B and 4R are formed, the slurry in which the pigment and the silica micro-beads are dispersed is utilized. Therefore, upon exposure, ultraviolet rays are introduced into the boundary of the panel 1 through the transparent silica micro-beads, thereby effecting a sufficient exposure.

Figure 2:
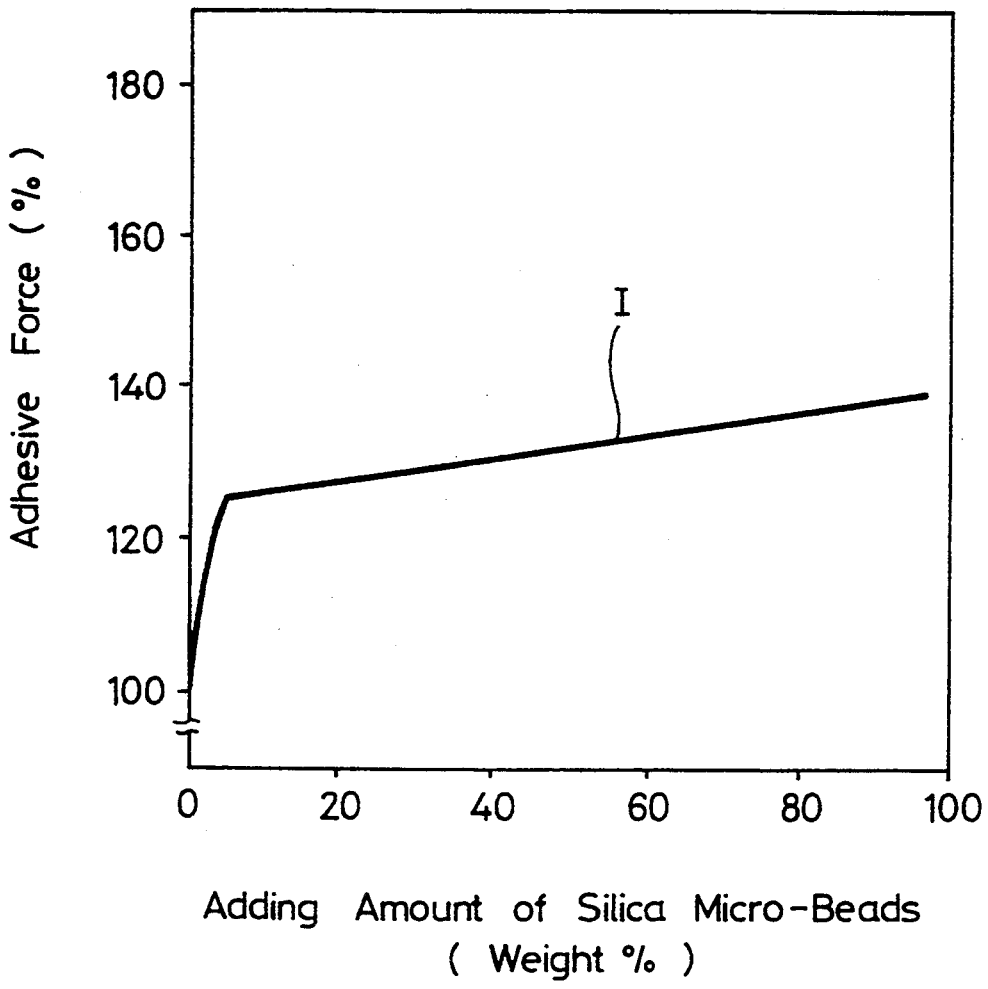
FIG. 2 is a characteristic graph showing a relationship between an adding amount of silica micro-beads and an adhesive force, and to which references will be made in explaining the present invention.

Consequently, an adhesive force with which the color filters 4G, 4B, 4R are bonded on the inner surface of the panel 1 is increased 25% as compared with the prior art as shown by a characteristic curve I that shows a relationship between the adding amount of silica micro-beads and an adhesive force in FIG. 2. Thus, the width of the color filter stripe can be controlled with ease and the color filter stripe of desired width can be obtained.

Figure 3:
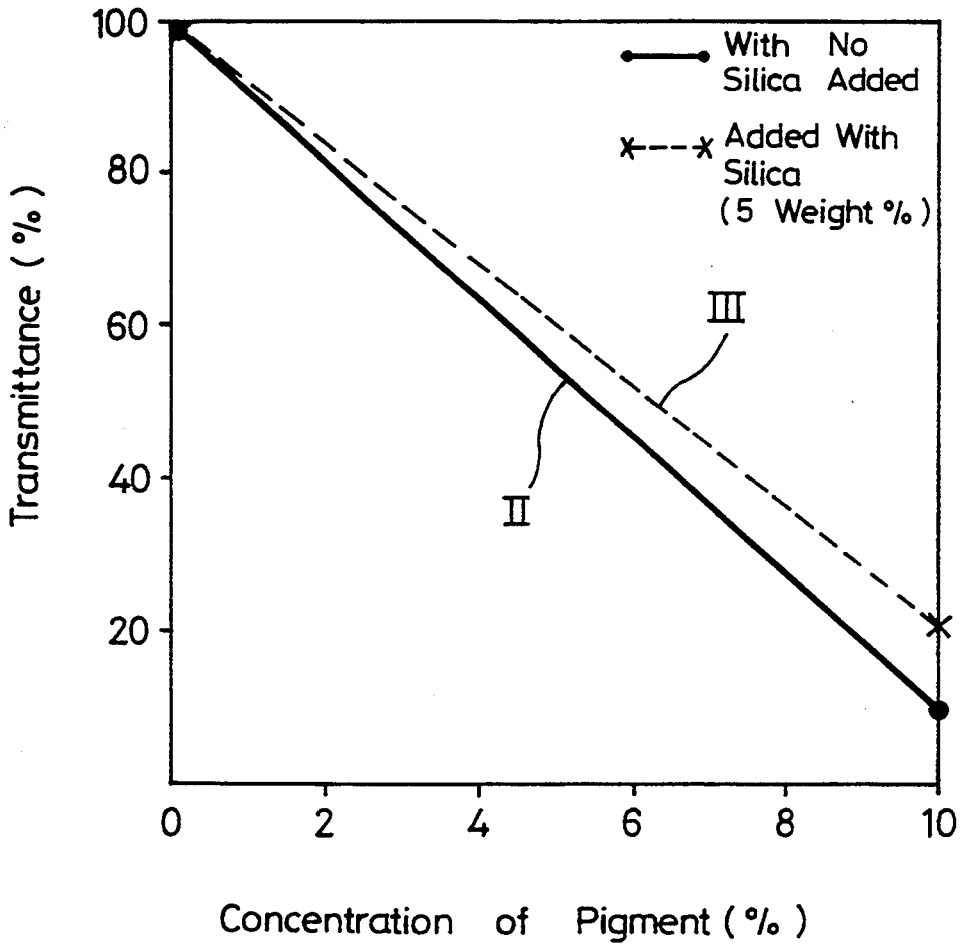
FIG. 3 is a characteristic graph showing a relationship between a concentration of pigment and a transmittance, and to which references will be made in explaining the present invention.

The transparent silica micro-beads are served as a bridging element for pigments, and transmittance of each of the color filter stripes 4G, 4B and 4R provided after the baking-process is improved 5% as shown by a straight line III in FIG. 3. FIG. 3 is a characteristic graph showing a relationship of transmittance versus pigment concentration of color filter stripe. In FIG. 3, the straight line III shows measured results of the color filter stripe of the embodiment 1 into which the silica micro-beads of 5 weight % are added. A straight line II shows measured results of the color filter stripe into which the silica micro-beads are not added.

EMBODIMENT 2

Polyethylene particles (particle diameter is 0.3 μm to 5.0 μm) are utilized as transparent particles and the rest of the composition is selected to be similar to that of the embodiment described above. Then, the color filter stripes 4G, 4B, 4R are formed on which the respective color phosphor stripes 5G, 5B, and 5R are formed. Then, the intermediate film 6 and the metal-backing layer 7 are formed to form a target color phosphor screen.

Also in another embodiment, the phosphor screen can be sufficiently exposed up to the boundary of the panel 1 with ultraviolet rays by means of the polyethylene particles similarly to the first embodiment, whereby the color filter stripes 4G, 4B and 4R having predetermined width and strong adhesive force can be obtained. At the same time, the transmittance of the color filter stripes 4G, 4B and 4R can be increased.

Further, in the alternate embodiment, the polyethylene particles are lost in the succeeding baking process so that the phosphor screen is not seen white from the outside unlike the case where the inorganic particles are used. Accordingly, the contrast of the color cathode ray tube can be increased as compared with the embodiment.

While the present invention is applied to the case that the phosphor screen is formed of the phosphor stripes, the present invention is not limited thereto and can also be applied to the case that a phosphor screen is formed of phosphor dots.

Furthermore, while the present invention is applied to the color cathode ray tube as described above, the present invention is not limited thereto and can also be applied to a phosphor screen of a single color cathode ray tube for projector.

As set out, according to the present invention, in the method of forming a phosphor screen in which the color filter layers are formed between the phosphor layer and the inner surface of the panel, the color filter layers of predetermined width can be formed on the panel with a sufficient adhesive force. Also, the transmittance of the color filter layers can be increased. Therefore, it is possible to provide a cathode ray tube of high contrast and high brightness.

Having described preferred embodiments of the invention with reference to the accompanying drawings, it is to be understood that the invention is not limited to those precise embodiments and that various changes and modifications could be effected by one skilled in the art without departing from the spirit or scope of the invention as defined in the appended claims.

What is claimed is:

1. A method of manufacturing a phosphor screen of a cathode ray tube comprising the steps of:

forming a uniform coating layer of a slurry comprising pigment particles, a photo resist, transparent particles and a dispersant on an inner surface of a panel of said cathode ray tube;

exposing said coating layer using a photo mask having a predetermined pattern;

developing said exposed coating layer to form a color filter layer including said pigment particles and said transparent particles; and forming a color phosphor layer of phosphor particles on top of said color filter layer.

2. The method according to claim 1, wherein said transparent particles are particles selected from silica micro-bead, baked alumina, quartz bead, acryl-based resin particle, or polyethylene-based resin.

3. The method according to claim 1, wherein said transparent particle is selected as a transparent particle which is decomposed by heat of higher than a predetermined temperature and said transparent particle of 0.1 weight % to 70 weight % is contained in the total amount of a composition of said slurry and said transparent particle of 10 weight % to 100 weight % is contained in fine particle pigment.

* * * * *